US011060446B2

(12) United States Patent
Weiss

(10) Patent No.: US 11,060,446 B2
(45) Date of Patent: Jul. 13, 2021

(54) COMPRESSOR AND A METHOD FOR THE ASSEMBLY OF AN ACTUATION DEVICE IN THE COMPRESSOR

(71) Applicant: BMTS Technology GmbH & Co. KG, Stuttgart (DE)

(72) Inventor: Hartmut Weiss, Stuttgart (DE)

(73) Assignee: Mahle International GmbH

( * ) Notice: Subject to any disclaimer, the term of this patent is extended or adjusted under 35 U.S.C. 154(b) by 0 days.

(21) Appl. No.: 16/600,152

(22) Filed: Oct. 11, 2019

(65) Prior Publication Data

US 2020/0116077 A1 Apr. 16, 2020

(30) Foreign Application Priority Data

Oct. 12, 2018 (DE) ..... 102018217510.1

(51) Int. Cl.
*F02B 33/44* (2006.01)

(52) U.S. Cl.
CPC ..... *F02B 33/44* (2013.01)

(58) Field of Classification Search
CPC ..... F02B 33/44; F02B 37/16; F02B 37/162; F02B 37/164; F02B 37/166; F02B 37/168;

(Continued)

(56) References Cited

U.S. PATENT DOCUMENTS 3,150,650 A * 9/1964 Dreesen ..... F02C 6/12 123/559.1
4,618,311 A 10/1986 Miura et al.
(Continued)

FOREIGN PATENT DOCUMENTS

DE 3 320 699 C2 12/1984
DE 3 711 224 C2 8/1990
(Continued)

OTHER PUBLICATIONS

German Search Report for German Patent Application No. DE 10 2018 217 510.1, dated Oct. 17, 2019.
(Continued)

*Primary Examiner* — Jesse S Bogue
*Assistant Examiner* — Loren C Edwards
(74) *Attorney, Agent, or Firm* — Fishman Stewart PLLC

(57) ABSTRACT

A compressor may include a compressor housing in which may be formed a charge air passage through which charge air may be flowable, an actuator arranged on the charge air passage for adaptation of a cross-section of the charge air passage, the actuator having a flow arrangement for influencing a flow of charge air through the charge air passage, and a linear actuator. The compressor may also have a housing body accommodating the linear actuator and integrally formed on the compressor housing, and a closure cover of the compressor housing closing the housing body and the compressor housing in an airtight manner against an external environment. A movement of the linear actuator directed tangentially to the flow arrangement may bring the flow arrangement into at least of at least one closed position and at least one open position to enable the cross-section of the charge air passage to be adapted.

16 Claims, 3 Drawing Sheets

(58) Field of Classification Search
CPC ..... F02B 37/18; F02B 37/183; F02B 37/186; F02B 37/22; F02B 37/24; F04D 29/46; F04D 29/462; F04D 29/464; F04D 29/56; F04D 29/563; F04D 27/002; F04D 27/003; F04D 27/005; F04D 27/0246; F04D 27/0253; F04D 27/0269; F01D 17/12; F01D 17/14; F01D 17/16
See application file for complete search history.

(56) References Cited

U.S. PATENT DOCUMENTS

| | | | | |
|---|---|---|---|---|
| 4,836,746 | A | 6/1989 | Owsianny et al. | |
| 4,890,977 | A | 1/1990 | Tremaine et al. | |
| 8,641,363 | B2 | 2/2014 | Love et al. | |
| 2002/0078934 | A1* | 6/2002 | Hohkita ..... | F02B 37/16 123/564 |
| 2010/0129205 | A1 | 5/2010 | Schwerdel | |
| 2017/0298943 | A1 | 10/2017 | Mohtar et al. | |
| 2017/0298953 | A1* | 10/2017 | Lombard ..... | F16K 3/03 |

FOREIGN PATENT DOCUMENTS

| | | | |
|---|---|---|---|
| DE | 10 2006 033 976 | A1 | 1/2008 |
| DE | 10 2007 055 627 | A1 | 5/2009 |
| WO | WO-2008 155 400 | A1 | 12/2008 |

OTHER PUBLICATIONS

English Abstract for DE102006033976A1.
English Abstract for DE102007055627A1.

* cited by examiner

COMPRESSOR AND A METHOD FOR THE ASSEMBLY OF AN ACTUATION DEVICE IN THE COMPRESSOR

CROSS-REFERENCE TO RELATED APPLICATIONS

This application claims priority to German Patent Application No. DE 10 2018 217 510.1, filed on Oct. 12, 2018, the contents of which are hereby incorporated by reference in its entirety.

TECHNICAL FIELD

The invention concerns a compressor for the compression of charge air for an internal combustion engine, and a method for the assembly of an actuation device in the compressor.

BACKGROUND

A generic design of compressor has a compressor inlet and a compressor outlet, between which is arranged an impeller for the compression of charge air. The compressor inlet and the compressor outlet are connected to each other in terms of airflow by way of a charge air flow path. In order to extend the characteristics map of the compressor beyond the surge line, an actuation device with an adjustable flow arrangement and a drive for the actuation of the flow arrangement in the inflow or outflow region of the impeller is often arranged in the compressor. The flow arrangement usually comprises a plurality of elements, which can be adjusted relative to each other by means of the drive, and by this means a flow cross-section of the charge air flow path can be altered. By this means the actuation device can influence the flow of the charge air in such a way that the limiting effects are reduced or avoided. As a rule, the flow arrangements in the actuation device are actuated by the drive—usually an electric, or a pneumatic, or a hydraulic, linear actuator. Here the linear actuators are usually mounted as separate components in a housing on the compressor.

DE 3 320 699 C2 discloses such a linear actuator for a compressor. The linear actuator is integrated into a housing and pushes against a block mounted on the housing, so as to adjust an actuation ring, or an actuation ram, of a flow arrangement. WO 2008 155 400 A1 and US 2017 298 943 A1 each disclose a linear actuator, which is flanged onto the exterior of a compressor housing. Here the linear actuator is sealed from the compressor interior by a flange between the linear actuator and the compressor housing. DE 3 711 224 C2 discloses an actuation rod for the actuation of an actuation ring of a flow arrangement. Here the motor actuating the actuation rod is located external to the compressor. U.S. Pat. No. 4,890,977 A discloses a linear actuator for the actuation of an actuation ring of a flow arrangement. US 2010 129 205 A1 discloses a compressor housing into which an actuator is inserted and covered with a cap. Here the actuator is not connected to an interior space of the compressor. U.S. Pat. No. 8,641,363 B2 discloses an actuator that is integrated into a compressor housing. Here the actuator is connected to the interior space of the compressor by apertures and by this means is cooled by the charge air.

The disadvantage of using a linear actuator arranged external to the compressor housing is that a shaft or actuator rod of the linear actuator must pass through the compressor housing. The point of connection between the shaft or actuation rod and the compressor housing must be sealed in a complex manner by a movement seal. Components of the actuation device located outside the compressor housing are exposed to dirt and corrosion and must be additionally protected. If the linear actuator is arranged in a separate housing, it is exposed to radiant heat, in particular to the exhaust gas side located in the engine compartment, and thus to high temperatures, and must be shielded or cooled from these in a complex manner.

The object of the invention is therefore to specify an improved, or at least an alternative form of embodiment for a compressor of the generic type, in which the disadvantages described are at least partially overcome. A further object of the invention is to provide a simplified method for the assembly of an actuation device in the compressor.

SUMMARY

This object is achieved in accordance with the invention by means of the subject matter of the independent claims. Advantageous forms of embodiment are the subject matter of the dependent claims.

A compressor is provided for the compression of charge air for an internal combustion engine. Here the compressor has a compressor housing, in which is formed a charge air passage of the compressor, through which the charge air can flow in the direction of flow. The compressor also has an actuation device arranged on the charge air passage for the adaptation of a cross-section of the charge air passage through which the air can flow. The actuation device has a flow arrangement and a linear actuator, wherein the flow arrangement can be brought into at least one closed position and/or into at least one open position by a movement of the linear actuator, directed tangentially to the flow arrangement. By this means it is possible to adapt the cross-section of the charge air passage through which the air can flow. In accordance with the invention, a housing body accommodating the linear actuator is integrally formed on the compressor housing. Furthermore, a closure cover of the compressor housing closes the housing body and thus the compressor housing such that it is airtight against the external environment.

In the present invention, the charge air passage is to be understood as a section of the compressor housing through which the charge air can flow, and which has a small width or height in the direction of flow of the charge air. The width or height of the charge air passage is essentially defined by the width or height of the flow arrangement in the direction of flow. In addition to the housing body the compressor housing can comprise a spiral body and an inlet body to accommodate the linear actuator. The spiral body forms a spiral of the compressor, and accommodates an impeller of the compressor. A charge air inlet of the compressor can be formed in the inlet body, through which the charge air can flow to the impeller. Here the charge air section can be arranged both upstream and also downstream of the impeller in the compressor housing. The spiral body and the inlet body can preferably form an accommodation chamber for the accommodation of the flow arrangement, which is arranged radially outside the charge air passage and upstream of the impeller.

In the compressor according to the invention, the linear actuator is arranged in the compressor housing, so that a separate housing for the linear actuator is not necessary. The housing body and thus the compressor housing are sealed in an airtight manner against the external environment by the closure cover, and a dynamically stressed movement seal is not necessary here, as the linear actuator is wholly arranged in the compressor housing. In summary, the construction of the compressor can be simplified compared to conventional solutions, and the linear actuator can be protected against radiant heat, dirt and corrosion. Power or data cables leading to the linear actuator can advantageously be routed through an opening in the closure cover and the opening can be sealed against the external environment. The flow arrangement can be, for example, an orifice plate arrangement, an upstream row of guide vanes, a downstream row of guide vanes, or a variable diffuser.

Advantageously provision can be made for the closure cover to be pressed or screwed onto the housing body and thus onto the compressor housing. For this purpose, the housing body and thus the compressor housing can have a compression flange, on which the closure cover can be fixed in position in a sealing manner. Between the closure cover and the housing body, and thus between the closure cover and the compressor housing, a cover seal can be arranged, which seals the housing body and thus the compressor housing against the external environment. Here the cover seal is not subjected to any dynamic stress, so that a durable and simple seal of the compressor housing is made possible.

In an advantageous development of the inventive compressor, provision is made for the linear actuator to have a ram. Here the ram acts in conjunction with an active surface of the flow arrangement and, by means of a movement tangential to the flow arrangement, brings the flow arrangement into the at least one closed position or into the at least one open position. The ram can be designed to be convex at its longitudinal end interacting with the active surface, and the active surface can be designed to be curved. Alternatively, the ram can be designed to be flat at its longitudinal end interacting with the active surface, as can the active surface. The flow arrangement can, for example, be an orifice plate arrangement, which has an actuation ring, and a carrier ring fixed in position in, or integrally formed in, the charge air passage, wherein openings through which flow can pass are opened or closed by a rotation of the actuation ring relative to the carrier ring. The linear actuator then interacts as intended with the actuation ring and adjusts the latter relative to the carrier ring. Correspondingly, the openings through which flow can pass are completely, or at least partially, open in the at least one open position, and completely, or at least partially, closed in the at least one closed position. The linear actuator can have an electromechanical, or a pneumatic, or a hydraulic actuator, which actuates the ram of the linear actuator tangentially to the flow arrangement.

Advantageously, provision can be made for the actuation device to be provided with a reset arrangement. The reset arrangement then interacts with the flow arrangement, in the opposite direction to the ram, and brings the flow arrangement into the at least one open position, or the at least one closed position. The reset arrangement preferably has at least one spring, so that the actuation device can be constructed in a particularly simplified and robust manner. Furthermore, the flow arrangement can be articulated directly and free of backlash by means of a spring-loaded durable contact. The reset arrangement and the flow arrangement can advantageously form an assembly unit introduced into the compressor housing. Here the assembly unit is fixed in position in the compressor housing in such a way that the linear actuator can be introduced into the housing body, and thus into the compressor housing, in the assembly direction, and can thereby be coupled with the reset arrangement in an interactive manner. Here the assembly direction is parallel to the tangentially directed movement of the linear actuator. By this means the linear actuator can be mounted in a simplified manner in the compressor housing. Alternatively, the reset arrangement and the linear actuator can form an assembly unit, wherein the assembly unit can be introduced into the housing body and thus into the compressor housing in the assembly direction. Here the assembly direction is parallel to the tangentially directed movement of the linear actuator. Alternatively, the ram of the linear actuator can be fixed in position on the active surface in a form-fitted or materially-bonded manner, such that a reset arrangement is not necessary.

In a development of the compressor, provision is advantageously made for the linear actuator to be introduced into the housing body, and thus into the compressor housing, in the assembly direction. Here the assembly direction is parallel to the movement of the linear actuator directed tangentially to the flow arrangement. During assembly, the linear actuator can then be introduced into the housing body in the assembly direction, and the closure cover can close the housing body and thus the compressor housing. By this means the assembly of the linear actuator can be considerably simplified.

The ram of the linear actuator can advantageously be guided in the assembly direction through a base of the housing body extending radially with respect to the assembly direction of the linear actuator. Since the assembly direction of the linear actuator is parallel to the movement of the linear actuator directed tangentially to the flow arrangement, the ram of the linear actuator can also interact with the flow arrangement when the linear actuator is inserted into the housing body. By this means the need to align the ram with the flow arrangement can be eliminated and the assembly of the linear actuator is simplified. In order to protect the actuator components of the linear actuator from the pressure prevailing in the compressor housing, provision can be made for the base of the housing body to be sealed by a ram seal around the ram of the linear actuator that is guided through the base, thereby sealing the actuator components of the linear actuator in the housing body from the charge air passage of the compressor.

In an advantageous design of the compressor, provision is made for the base of the housing body to form a stop for the linear actuator in the assembly direction. Alternatively, the linear actuator can be fixed in position on the closure cover. Here the closure cover is preferably produced by an overmoulding of the linear actuator or by an injection moulding on the linear actuator. In both designs, the linear actuator is fixed in position in the assembly direction when it is inserted into the housing body, so that a subsequent correctly spaced alignment of the linear actuator with the flow arrangement, and, in particular, of the ram of the linear actuator with the active surface, can be omitted. By this means the assembly of the linear actuator can be simplified.

In summary, the construction of the inventive compressor is considerably simplified. The linear actuator is arranged in the compressor housing, thus eliminating the need for a separate housing for the linear actuator and a dynamically stressed movement seal. The linear actuator is also extensively protected against radiant heat, dirt and corrosion.

The invention also concerns a method for the assembly of an actuation device in the above-described compressor. Here the flow arrangement of the actuation device is arranged on the charge air passage of the compressor. For this purpose, the flow arrangement can, for example, be placed in an accommodation chamber of the compressor housing, and can then be fixed in position by an inlet body and a spiral body in the accommodation chamber. The linear actuator of the actuation device is then introduced in the assembly direction into the housing body integrally formed on the compressor housing, and by this means is arranged so as to interact with the flow arrangement. The housing body and thus the compressor housing are sealed in an airtight manner against the external environment by the closure cover.

Further important features and advantages of the invention ensue from the subsidiary claims, from the figures, and from the related description with reference to the figures.

It is to be understood that the features mentioned above, and those yet to be explained below, can be used not only in the particular combination specified, but also in other combinations, or in isolation, without departing from the scope of the present invention.

Preferred examples of embodiment of the invention are shown in the figures and are explained in more detail in the following description, wherein the same reference symbols refer to the same, or similar, or functionally identical, components.

BRIEF DESCRIPTION OF THE DRAWINGS

Here, in schematic form in each case.

DETAILED DESCRIPTION

Figure 1:
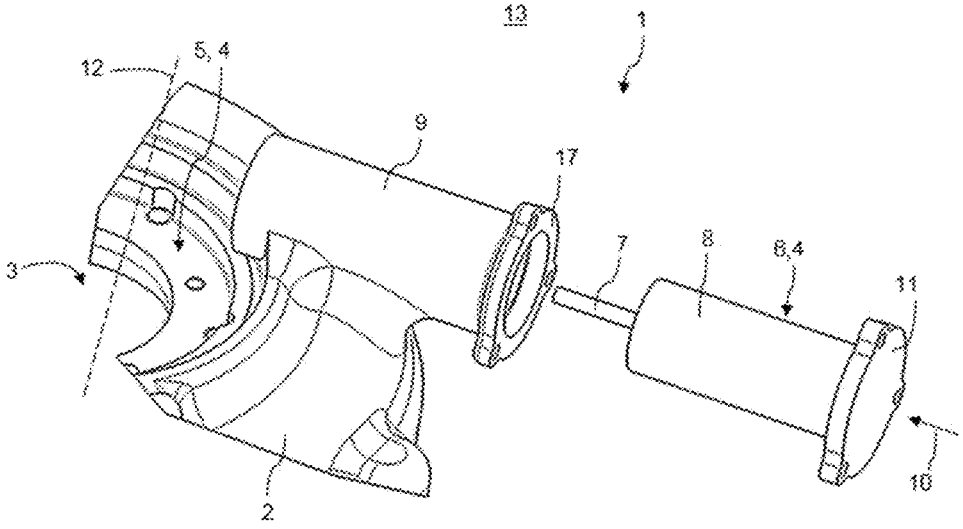
FIG. 1 shows a detail view of a compressor according to the invention during the assembly of an actuation device.

FIG. 1 shows a detail view of an inventive compressor 1 in the course of assembly. Here the compressor 1 has a compressor housing 2, in which is formed a charge air passage 3 of the compressor 1, through which the charge air can flow in the direction of flow 12. Here the charge air passage 3 is formed by a section of the compressor housing 2 through which the air can flow. The compressor 1 also has an actuation device 4 for adaptation of the cross-section of the charge air passage 3 through which the air can flow. Here the actuation device 4 comprises a flow arrangement 5—here an orifice plate arrangement 5—and a linear actuator 6. Here the linear actuator 6 has a linearly moving ram 7 and an electromechanical, or a pneumatic, or a hydraulic, actuator 8. A housing body 9 is integrally formed on the compressor housing 2, into which the linear actuator 6 can be introduced in the assembly direction 10 tangential to the orifice plate arrangement 5. The ram 7 is aligned in the assembly direction 10 such that a movement of the ram 7 is tangential to the orifice plate arrangement 5 and parallel to the assembly direction 12.

A closure cover 11 closes the housing body 9 and thus the compressor housing 2 in an airtight manner against the external environment. To fix the closure cover 11 in position on the housing body 9 and thus on the compressor housing 2, the housing body 9, and thus the compressor housing 2, have a compression flange 17, on which the closure cover 11 is supported after the linear actuator 6 has been inserted into the housing body 9. The closure cover 11 can be screwed onto the compression flange 17. In this example of embodiment, the closure cover 11 is fixed in position on the linear actuator 6, so that the linear actuator 6 is fixed in position in the assembly direction 10 by the closure cover 11 fixed in position on the compression flange 17.

In the course of assembly of the actuation device 4 in the compressor 1 using a method 13, the orifice plate arrangement 5 of the actuation device 4 is firstly arranged on the charge air passage 3. The linear actuator 6 is then introduced into the housing body 9 integrally formed on the compressor housing 2 in the assembly direction 10, and is thereby arranged so as to interact with the orifice plate arrangement 5. The housing body 9 and thus the compressor housing 2 are closed by the closure cover 11 in an airtight manner against the external environment.

Figure 2:
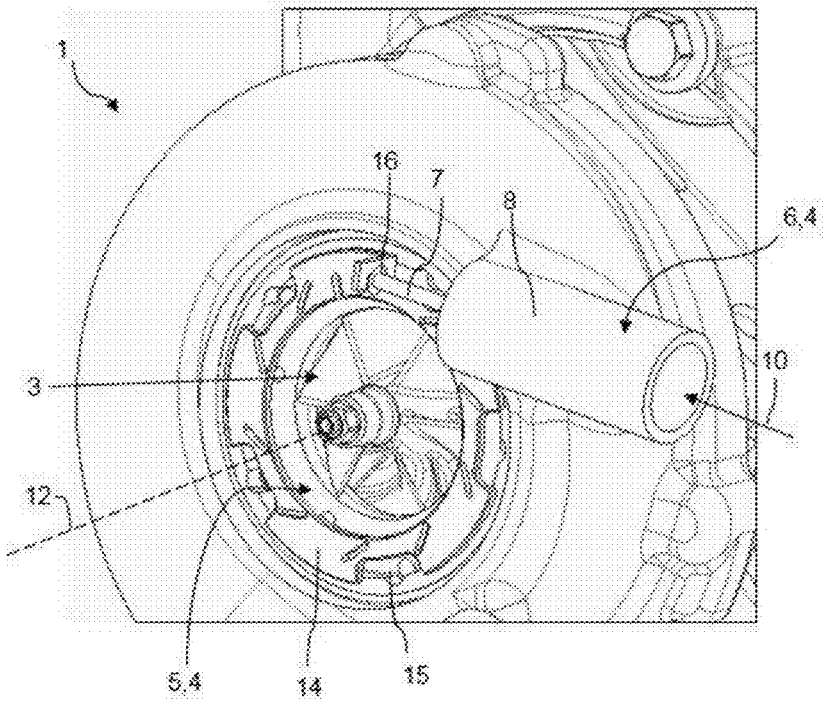
FIGS. 2 and 3 show detail views of the compressor according to the invention with a different design of actuation device.
Figure 3:
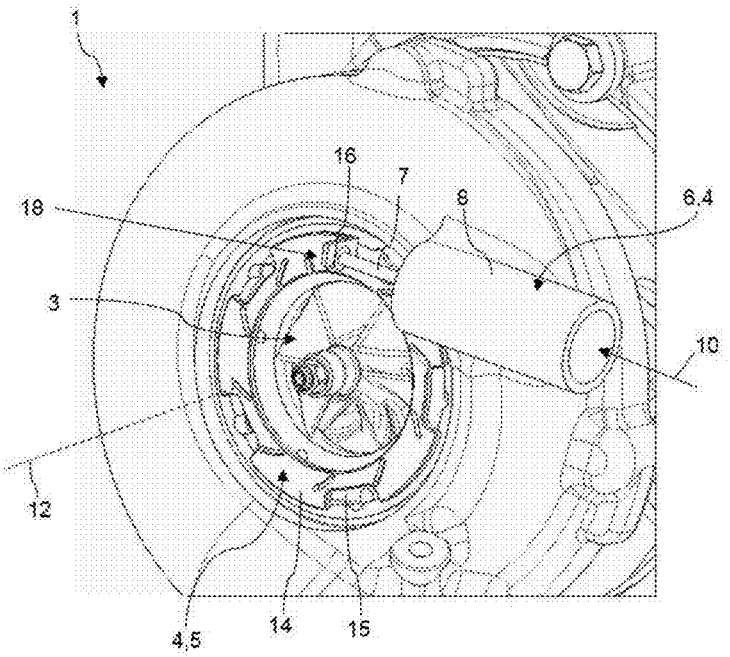

FIG. 2 and FIG. 3 show further views of the inventive compressor 1. Here, for the sake of clarity, an intake port of the compressor 1 is not shown. In this example of embodiment, the orifice plate arrangement 5 has an actuation ring 14 and a carrier ring 15. The carrier ring 15 is fixed in position to, or integrally formed with, the charge air passage 3—and thus to the compressor housing 2—and the actuation ring 14 is arranged on the carrier ring 15 such that it can rotate. In addition, an active surface 16 is designed on the actuation ring 14, with which the ram 7 of the linear actuator 6 interacts. A movement directed tangentially to the orifice plate arrangement 5 causes the ram 7 to press against the active surface 16, causing the actuation ring 14 to rotate relative to the carrier ring 15. By this means the linear actuator 6 brings the orifice plate arrangement 5 into the at least one closed position or into the at least one open position. In FIG. 3 the ram 7 is positively fixed in position on the active surface 16 by a form-fit unit 18, so that the actuation ring 14 can also be reset by the ram 7. In FIG. 2 the ram 7 is not fixed in position on the active surface 16. Here the actuation ring 14 can be reset by a reset arrangement—not shown here.

Figure 4:
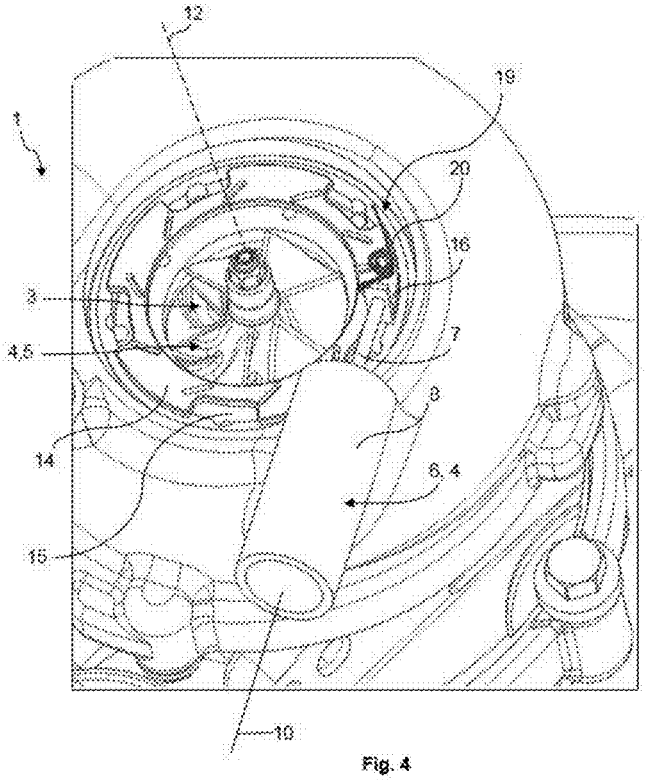
FIGS. 4 to 6 show detail views of the compressor according to the invention with an actuation device with a reset arrangement.
Figure 5:
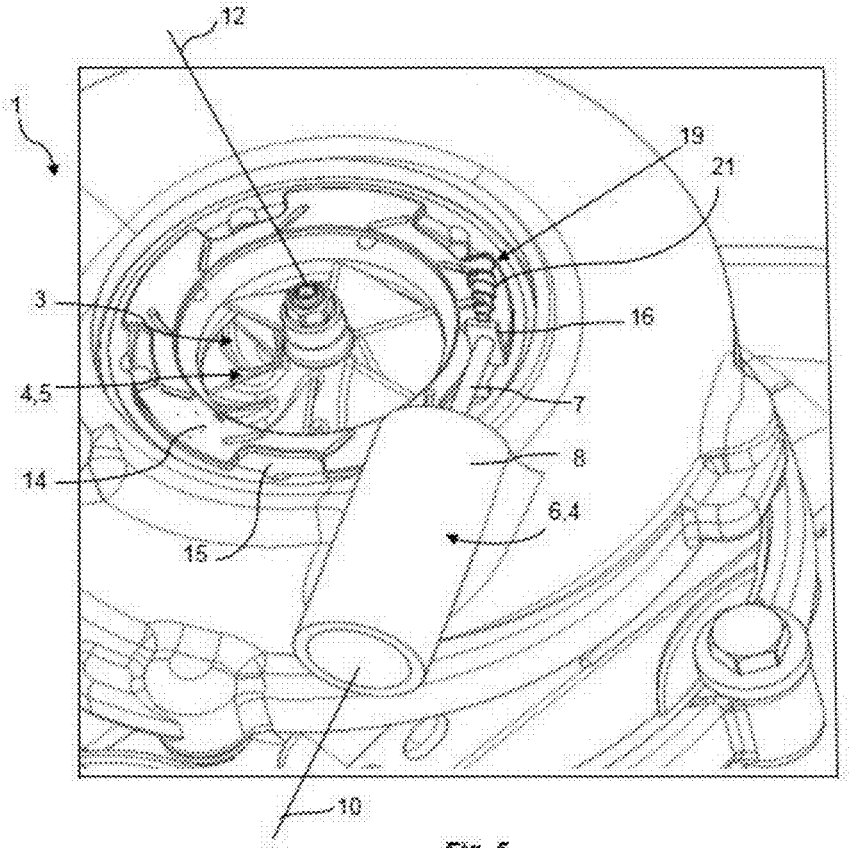
Figure 6:
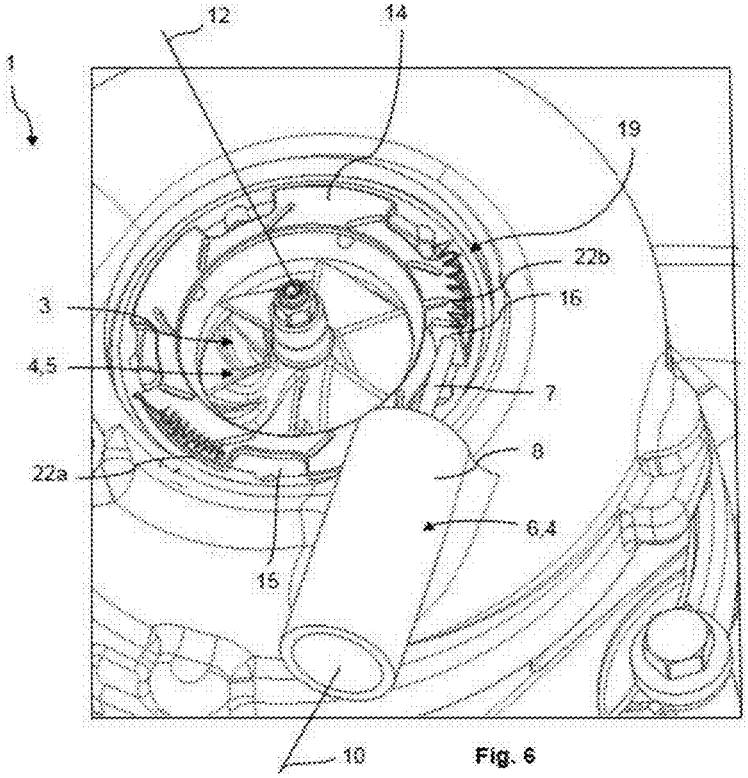

FIG. 4 to FIG. 6 show further views of the inventive compressor 1. Here the actuation device 4 in each case has a different design of reset arrangement 19. In FIG. 4 the reset arrangement 19 has a leg spring 20, and in FIG. 5 an involute spring 21. In a deviation from these, the reset arrangement 19 in FIG. 6 has a helical tension spring 22*a* and a helical compression spring 22*b*. Regardless of its design, the reset arrangement 19 acts together with the orifice plate arrangement 5 in the opposite direction to the ram 7, and preloads the actuation ring 14 against the carrier ring 15.

In summary, the construction of the inventive compressor 1 can be simplified in comparison to conventional solutions, and the linear actuator 6 can be protected against radiant heat, dirt and corrosion.

The invention claimed is:

1. A compressor for compression of charge air for an internal combustion engine, comprising:

a compressor housing in which is formed a charge air passage through which the charge air is flowable in a flow direction;

an actuator arranged on the charge air passage for an adaptation of a cross-section of the charge air passage, the actuator having a flow arrangement for influencing a flow of the charge air through the charge air passage, and a linear actuator;

a housing body accommodating the linear actuator and integrally formed on the compressor housing;

a closure cover of the compressor housing closing the housing body and the compressor housing in an airtight manner against an external environment;

wherein a movement of the linear actuator directed tangentially to the arrangement of the actuator brings the actuator into at least one of at least one closed position and at least one open position to enable the cross-section of the charge air passage to be adapted; and wherein the closure cover is attached to a distal end of the linear actuator such that the linear actuator is wholly arranged in the compressor housing.

2. The compressor in accordance with claim 1, wherein at least one of:

the closure cover is pressed or screwed onto the housing body; and a cover seal is arranged between the closure cover and the housing body and seals the housing body against the external environment.

3. The compressor in accordance with claim 1, wherein the linear actuator has an electromechanical, a pneumatic, or a hydraulic actuator.

4. The compressor in accordance with claim 1, wherein the linear actuator has a ram, which interacts with an active surface of the flow arrangement, and, by the movement directed tangentially to the flow arrangement, brings the flow arrangement into the at least one closed position or into the at least one open position.

5. The compressor in accordance with claim 4, wherein one of:

the ram is designed to be convex at a longitudinal end of the ram interacting with the active surface, and the active surface is designed to be curved; or the ram and the active surface each is designed to be flat at a respective longitudinal end interacting with each other.

6. The compressor in accordance with claim 4, wherein the actuator has a reset arrangement, which interacts with the flow arrangement in the opposite direction to the ram, and brings the flow arrangement into the at least one open position or into the at least one closed position.

7. The compressor in accordance with claim 6, wherein one of:

the reset arrangement and the linear actuator form an assembly unit, wherein the assembly unit is able to be introduced into the housing body in an assembly direction, which is parallel to the movement of the linear actuator directed tangentially to the flow arrangement; or the reset arrangement and the flow arrangement form an assembly unit introduced into the compressor housing, wherein the linear actuator is able to be introduced into the housing body in the assembly direction and coupled in an interactive manner with the reset arrangement.

8. The compressor in accordance with claim 6, wherein the reset arrangement has at least one spring.

9. The compressor in accordance with claim 8, wherein the at least one spring includes one of:

a leg spring;

an involute spring; or a helical tension spring and a helical compression spring.

10. The compressor in accordance with claim 4, wherein the ram of the linear actuator is fixed in position on the active surface in a form-fitted or materially-bonded manner.

11. The compressor in accordance with claim 1, wherein the linear actuator is able to be introduced into the housing body in an assembly direction, which is parallel to the movement of the linear actuator directed tangentially to the flow arrangement.

12. The compressor in accordance with claim 11, wherein the ram of the linear actuator is guided in the assembly direction through a base of the housing body extending radially with respect to the assembly direction of the linear actuator.

13. The compressor in accordance with claim 12, wherein the base of the housing body is sealed around the ram of the linear actuator that is guided through the base, such that the linear actuator in the housing body is sealed from the charge air passage.

14. The compressor in accordance with claim 12, wherein one of:

the base of the housing body forms a stop for the linear actuator in the assembly direction; or the linear actuator is fixed in a position on the closure cover in the assembly direction.

15. The compressor in accordance with claim 14, wherein the linear actuator is fixed in the position on the closure cover by an overmoulding of the linear actuator.

16. The compressor in accordance with claim 1, wherein the flow arrangement includes an orifice plate arrangement.

* * * * *